US005671822A

United States Patent [19]

Phillips

[11] Patent Number: 5,671,822

[45] Date of Patent: Sep. 30, 1997

[54] SELF-BELAYING DESCENDING APPARATUS

[76] Inventor: Webster C. Phillips, 8319 Fountain Ave., Los Angeles, Calif. 90069

[21] Appl. No.: 529,165

[22] Filed: Sep. 15, 1995

[51] Int. Cl.[6] ..... A62B 1/00; A62B 1/06; A62B 1/16; A62B 35/00

[52] U.S. Cl. ..... 182/5; 182/6; 182/7; 182/191; 182/193

[58] Field of Search ..... 182/191, 5, 6, 182/7, 72, 193; 114/218

[56] References Cited

U.S. PATENT DOCUMENTS

| | | | |
|---|---|---|---|
| 272,259 | 2/1883 | Howland | 182/5 |
| 890,898 | 6/1908 | Gaillac | 182/191 |
| 963,409 | 7/1910 | Welch | 182/191 |
| 1,574,529 | 2/1926 | Abraham | 182/6 |
| 2,245,878 | 6/1941 | Sorensen | 114/218 |
| 3,498,408 | 3/1970 | Foote | 182/6 |
| 4,039,045 | 8/1977 | Höger | 182/5 |

FOREIGN PATENT DOCUMENTS

| | | | |
|---|---|---|---|
| 289404 | 7/1953 | Switzerland | 182/5 |

*Primary Examiner*—Leslie A. Braun
*Assistant Examiner*—Donald J. Wallace
*Attorney, Agent, or Firm*—Albert O. Cota

[57] ABSTRACT

A self-belaying descending apparatus (10) comprising a descending control device (12), a safety line (30) and a body support (50) that can consist of a waist belt (74). The apparatus (10) functions by securing the upper end (32) of the line (30) to a fixed elevated structure (90). The lower end (34) of the line (30) is then wrapped around a pair of upper and lower line controls (24,26) attached to the device (12), and the device (12) is secured to the waist belt (74). The apparatus (10) is disclosed in two designs. In the first design, a single person is able to descend from the elevated structure (90). In the second design, the device (12) and safety line (30) function in combination with a modified device (12) and the body support (50) consist of a safety cage (100) that allows at least two persons to descend. In both designs, the descent rate is controlled by applying hand pressure to the safety line (30) wrapped around the upper and lower line controls (24,26).

11 Claims, 4 Drawing Sheets

SELF-BELAYING DESCENDING APPARATUS

TECHNICAL FIELD

The present invention pertains in general, to personal safety equipment and more particularly to an improved self-belaying descending apparatus used to lower persons from the upper levels of a building during a fire or other disaster which causes conventional means of escape impossible.

BACKGROUND ART

A common form of safety equipment for safeguarding against the risk of falling from a considerable height consists of a safety line gripped by a person and attached at its upper end to a fixed anchorage. Generally, this type of safety equipment is buckled through a waist belt to control the descend but the escapee must possess sufficient physical strength to be capable of controlling the descend speed. If the person does not possess sufficient strength, the descend may be to rapid causing serious injury upon landing or attempting to slow the descend speed by using the hands as a brake on the safety line can cause severe rope burns on the hands as well as the arms. There are other various devices disclosed for descending from an upper level structure. These other devices include ropes, cables and other safety lines that operate in combination with a control descend device. For the most part, these control descend devices are complex in design and require experienced personnel to master the use and mechanics of the devices.

Another form of safety equipment in common use is an escape ladder constructed from hemp, nylon, chain-link or other flexible material. The ladder is typically suspended from a window sill by associated hooks or otherwise attached to a secure anchorage. While an escape ladder enables some individuals to escape safely, there are disadvantages. The most evident disadvantage is that a person may not be physically capable or sufficiently coordinated to climb down the ladder. Also, a relatively large amount of storage space is required and a certain amount of preparation time is necessary to set up and use the escape ladder.

Accordingly, there is a need for an improved self-belaying descending apparatus which is simple, effective and avoids the disadvantages of the prior art devices.

A search of the prior art did not disclose any patents that read directly on the claims of the instant invention, however the following U.S. patents are considered related:

| PATENT NO. | INVENTOR | ISSUED |
|---|---|---|
| 5,217,092 | Potter | 8 June 1993 |
| 649,458 | Ives | 15 May 1900 |
| 316,870 | Braunfeld | 28 April 1885 |

The U. S. Pat. No. 5,217,092 Potter patent discloses a self-belaying and descent device which has a triaxial junction. The junction includes a rope wrap leg, a rope deflector leg and a rope clamp leg which are joined at a central area. The device also includes a structure for retaining a rope in a desired configuration around the triaxial junction. This device, when used with one rope configuration, will travel freely up a rope during climbing, but lock securely in place if the climber should fall. When used with an alternative rope configuration, the device allows a climber to safety descend a rope.

The U.S. Pat. No. 69,458 Ives patent discloses a slidable fire escape device adapted to operate in connection with a flexible suspension device. The device comprises a plate having a plurality of oppositely-curved portions connected at their ends by a straight web. The curved portions have openings through which the flexible suspension device is passed. A carrier connected to each end of the body-place with the carriers being oppositely directed and each comprising a pair of relatively angularly connected plates from the point of divergence of which the load is adapted to be suspended and two supplemental cupped plates. Each plate is connected at one end, one with the lower and the other with the upper end of the body-plates and at the other end with one of the plates of which one of the carriers is confused.

The U.S. Pat. No. 316,870 Braunfeld patent discloses a fire escape device having a block which is formed with a top loop, side hooks, a neck and a bottom loop. The device is used with a rope which passes through the top loop and around the neck and under the side hooks. The device when so configured permits the descent of the person to whom the device is attached.

For background purposes and as indicative of the art to which the invention relates, reference may be made to the following remaining patents found in the search:

| PATENT | INVENTOR | ISSUED |
|---|---|---|
| 4,515,240 | Curtis | 5 July 1985 |
| 3,814,210 | Hoffman | 4 June 1974 |
| 3,717,219 | Hoffman | 20 February 1973 |
| 3,357,520 | Foote | 12 December 1967 |
| 3,260,323 | McGowan | 12 July 1966 |
| 3,026,759 | Sweigart | 27 March 1962 |
| 2,948,348 | Bott | 9 August 1960 |
| 1,958,877 | Yake | 15 May 1934 |
| 1,716,268 | Gosciewski | 19 August 1890 |
| 434,888 | Ross | 19 August 1890 |

DISCLOSURE OF THE INVENTION

The self-belaying descending apparatus is designed to provide a safe and expeditious method for descending from an elevated structure such as a building.

The apparatus is disclosed in two embodiments. The first embodiment is designed to allow a single person to descend from an elevated structure; in the second embodiment at least two persons can descend. In its most basic design, the first embodiment of the self-belaying descending apparatus consists of:

a) a descending control device comprising:
   (1) a vertical section having an upper end and a lower end. To the upper end is attached a line guide and to the lower end is attached a body support means,
   (2) an upper line control attached to the vertical section and located below the line guide, and
   (3) a lower line control attached to the vertical section, in alignment with the upper line control, and located above the body support, b) a safety line having an upper end and a lower end. The upper end has means for being attached to a fixed elevated structure and the lower end is inserted through the line guide and wrapped around the upper and lower line controls. The lower end of the safety line freely extends downward, and c) a body support having a front and back section, means for being securely attached to the body and means for attaching the body support means on the device to the front section of the body support.

The line guide of the device includes an open loop, where the open area of the loop faces inward. The body support means consists of an eyelet, the upper line control bas an open loop, where the open area of the loop faces upward and the lower line control has an open loop, where the open area of the loop faces downward. The body support can consists of a waist belt; a waist belt and cross harness; or a pair of pants attached to a shoulder harness. All the body supports have a front section to which is attached a carribiner which allows the body support eyelet on the descending control device to be attached.

The second embodiment utilizes a modified descending control device and a safety cage that allows at least two persons to descend from an elevated structure. The device has an upper end that is firmly attached to an upper section of the cage and a lower end that is attached to the lower section of the cage. The upper and lower open-loop line controls are attached normal to the device's vertical section and are spaced apart to allow two hands, if needed, to grasp the device with the safety line attached.

To operate the first design of the apparatus, the safety line wrapped around the upper and lower line controls are grasped and the person steps over the elevated structure commence the descend. The descend rate is controlled by the amount of hand pressure placed around the safety line wrapped around the device. To operate the second design of the apparatus, the safety line is likewise grasped and subsequently the pressure is releaesably controlled to allow the safety cage to descend slowly.

In view of the above disclosure, it is the primary object of the invention to provide an apparatus and method that allows a person or persons to quickly and safety descend from an elevated structure.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the self-belaying descending apparatus is presented in terms of a preferred and second embodiment. In the first embodiment, the invention allows a single person to descend safely from an elevated structure; in the second embodiment the invention is used in combination with a safety cage to allow at least two persons to safely descend from an elevated structure.

The preferred embodiment of the self-belaying descending apparatus 10 as shown in FIGS. 1–7, is comprised of three major elements: a descending control device 12, a safety line 30 and a body support 50.

Figure 1:
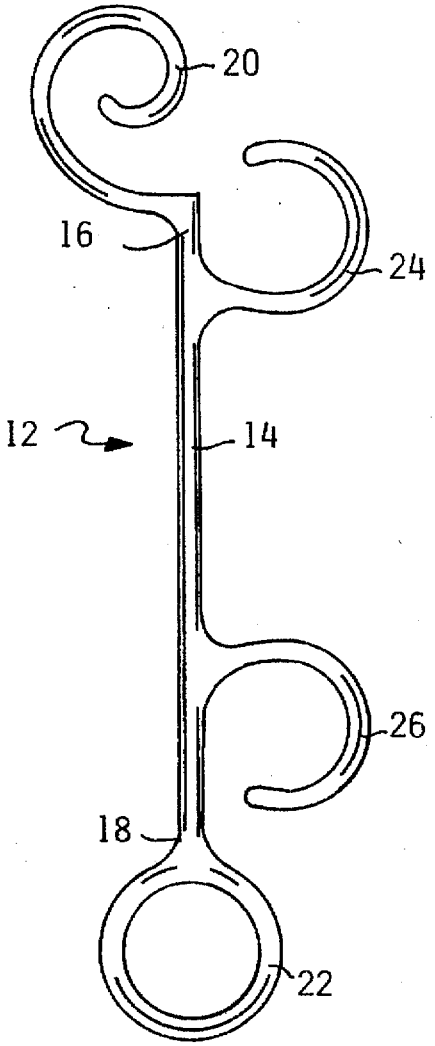
FIG. 1 is a side elevational view of the descending control device used in the first embodiment of the self-belaying descending apparatus.
Figure 2:
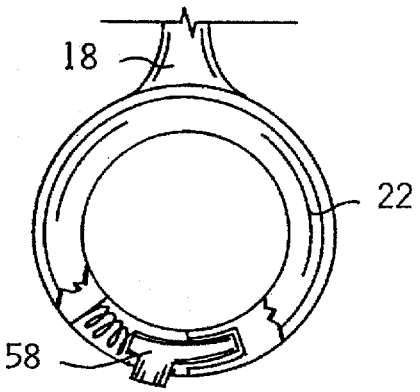
FIG. 2 is a partial elevational view of a descending control device with a body support eyelet having a spring-loaded slide lock.
Figure 4:
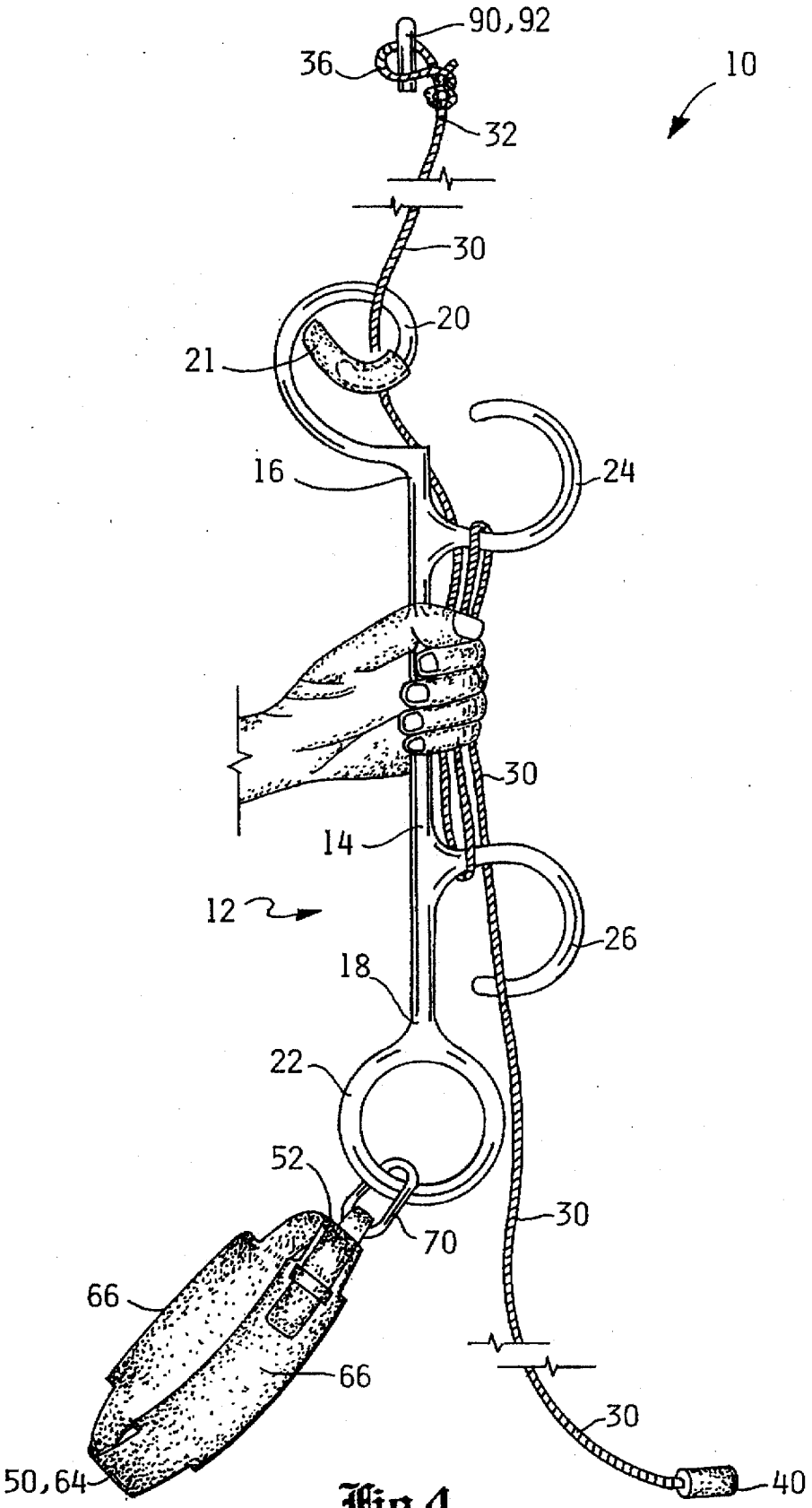
FIG. 4 is a side elevational view of a descending control device having a safety line placed through an open-loop line guide, around an upper and lower open-loop line controls and with a hand grasping the device and the safety line.

The descending control device 12 is shown as a separate element in FIG. 1 and as attached within the self-belaying descending apparatus 10 in FIG. 4. The device 12 includes a vertical section 14 having an upper end 16 and a lower end 18. The upper end 16 has an integrally attached line guide 20 and the lower end 18 has an integrally attached body support eyelet 22. The line guide 20 may include a slidable resilient sleeve, 21 as shown in FIG. 4. This sleeve when slid outward, prevents the safety line 30 from slipping out of the line guide to thus maintain the line in vertical alignment. The eyelet 22 may be configured with a spring-loaded slide lock 58 as shown in FIG. 2 which allows the eyelet 22 to be quickly and easily attached to a carribiner 70 on the body support 50 described infra. Located below the line guide 20 is an upper open-loop line Control 24 which is attached normal to the vertical section 14. Additionally, located above the eyelet 22 is a lower open-loop line control 26 which is also attached normal to the vertical section 14 and is in alignment with the upper open-loop line control 24.

Figure 3:
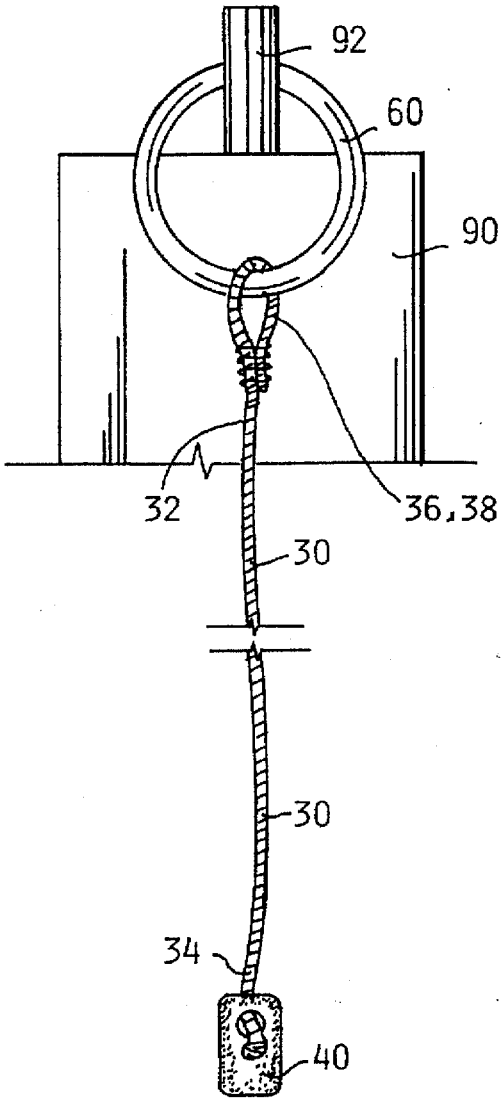
FIG. 3 is an elevational view of a safety line having attached to its upper end a metal ring that is attached to an upwardly extending protrusion and to its lower end a line stabilizing weight.

The descending control device 12 functions in combination with the safety line 30 as shown as a separate element in FIG. 3, and attached to the device 12 in FIG. 4. The line, which may be manufactured from nylon or other similar material, is attached to a fixed elevated structure 90 by an attachment means 36. One such means would be to simply tie the upper end 32 of the safety line 30 to the fixed elevated structure 90 which can consist of an upwardly extending protuberance 92 as shown in FIG. 4. Another means for attaching the safety line 30 includes using a metal ring 60 which is attached to a secured line loop 38 located on the upper end 32 of the safety line 30. In this case, the line 30 is quickly and easily secured by placing the metal ring 60 over the structure 90 that includes an upwardly extending protuberance 92 as shown in FIG. 3.

The lower end 34 of the line 30 is inserted through the line guide 20 and is wrapped around the upper and lower line controls 24 and 26 as shown in FIG. 4. The lower end 34 of the safety line 30 extends freely downward. To stabilize the downwardly extending line 30, a weight 40 may be attached to the lower end 34 as shown in FIGS. 3 and 4.

Figure 5:
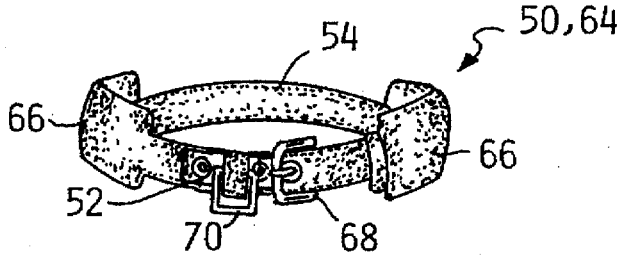
FIG. 5 is a perspective view of a body support configured as a waist belt.

The third and final element that comprises the self-belaying descending apparatus 10 is the body support structure 50 which is used in conjunction with the descending control device 12 to provide a safe and controlled descent. The body support 50 is disclosed in three designs. The first design as shown in FIGS. 4 and 5, consists of a waist belt 64. The belt includes side pads 66 and a buckle 68, which provides the means for attaching and adjusting the waist belt 64 to fit a person's body. A carribiner 70 is attached to the front section 52 and provides the means fop attaching the body support eyelet 22 on the descending control device 12.

Figure 6:
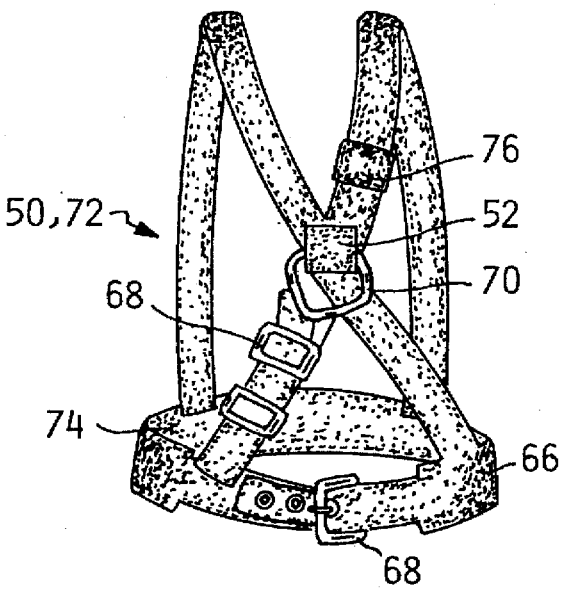
FIG. 6 is a perspective view of a body support configured as a waist belt and cross harness.

The second design 72 for the body support 50 is shown in FIG. 6 and consists of an integrated waist belt 74 add cross-harness 76 which includes a buckle 68. To the front section 52 of the cross harness 76 is attached a carribiner 70 to which is easily attached the body support eyelet 22 on the descending control device 12.

Figure 7:
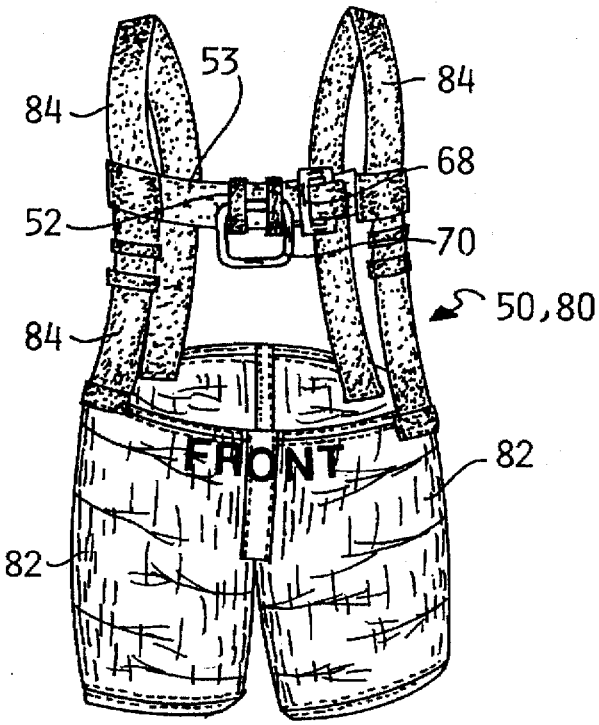
FIG. 7 is a perspective view of a body support configured with a pair of pants and shoulder harness.

The third and final design disclosed for the body support 50 is shown in FIG. 7. This design 80 incorporates a pair of pants 82 that are integrally attached to a shoulder harness 84 which includes a buckled horizontal strap 53 having a front section 52. To the front section 52 of the shoulder harness 84 is attached a carribiner 70 that accepts the body support eyelet 22 on the descending control device 12.

The first embodiment of the self-belaying descending apparatus 10 is operated by performing the following steps:

1. attach the upper end 32 of the safety line 30 to a fixed elevated structure 90. Attaching can be accomplished by tying the line 30 around a protuberance on the structure as shown in FIG. 4 or if the upper end 32 of the line has attached a metal ring 60, the ring can be placed over an upwardly extending protuberance 92 as shown in FIG. 4.
2. attach the body support 50 making certain that the front section 52 of the support is facing outward,
3. insert the lower end 34 of the safety line 30 through the open-loop line guide 20 of the descending control device 12. If the line guide 20 includes a slidable sleeve 21, slide the sleeve outward to prevent the safety line 30 from slipping out the line guide,
4. continue wrapping the safety line 30 around the upper and lower open-loop line controls 24 and 26 as shown in FIG. 4. The number of line wraps determine the uncontrolled descent rate and are dependent upon the body weight of the user,
5. attach the body support eyelet 22 on the descending control device 12 to the front section 52 of the body support 50,
6. grasp the line 30 wrapped around the upper and lower open-loop line controls 24 and 26 with at least one hand and step off the fixed elevated structure 90 to commence the descent and,
7. control the descent rate by applying hand pressure to the safety line 30 wrapped around the upper and lower line controls 24,26. When safely down, release the hand, remove the descending control device 12 from the body support 30 and subsequently remove the body support.

Figures 8, 9:
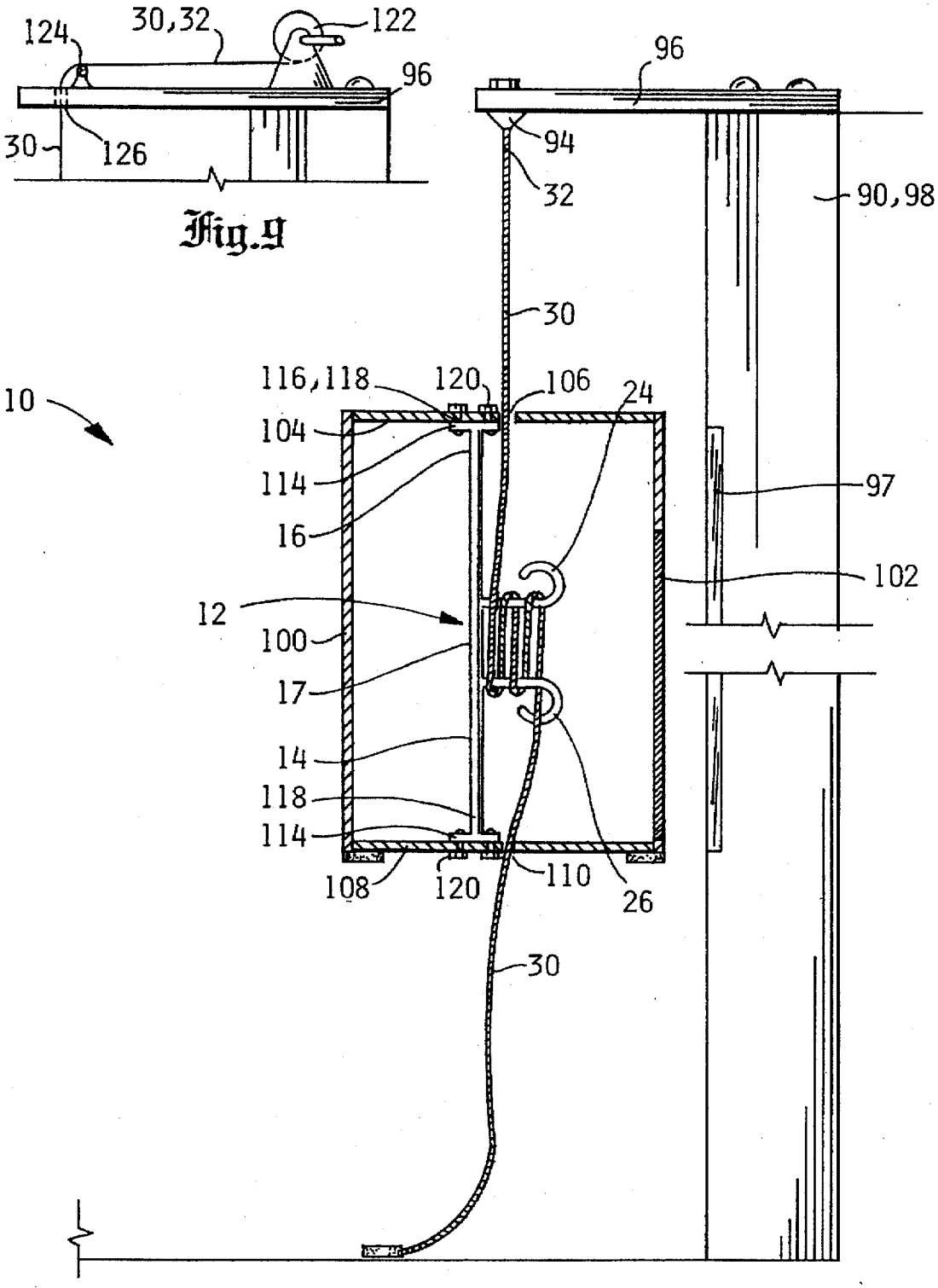
FIG. 8 is a side elevational view of the second embodiment that utilizes a descending control device that is attached to a safety cage with a safety line that passes through the safety cage and that is wrapped around the descending control device.
FIG. 9 is a partial elevational view showing an alternate means that utilizes a winch to secure the upper end of the safety line.

The second embodiment of the self-belaying descending apparatus 10 as shown in FIG. 8, comprises an enclosed safety cage 100 that is designed to hold at least two people and to be used in conjunction with a modified descending control device 12. The apparatus 10 is a permanently installed, ready-to-use structure that, when attached, the cage 100 is positioned adjacent to a window 97 on an elevated structure 90 such as building 98 as shown in FIG. 8. The enclosed safety cage 100 has a door 102 on one side that faces the window 97 and upper and lower sections 104 and 108. The upper section has therethrough an upper line bore 106 and the lower section has a lower line bore 110 therethrough that is in alignment with the upper line bore 106.

The descending control device 12 of the second embodiment includes a vertical section 14 having an upper end 16, a center point 17 and a lower end 18. The upper end 16 and lower end 18 are attached to the respective upper 104 and lower 108 sections of the enclosed safety cage 100 by means of metal plates 114 that are rigidly attached to the upper end 16 and lower end 18 of the vertical section 14. Each metal plate 114 has a plurality of bores 116 therethrough that are in alignment with a like plurality of bores 118 on the upper 104 and lower 108 sections of the enclosed safety cage 100. A bolt and nut combination 120 is inserted through each of the plurality of bores 116,118 to securely maintain the upper and lower ends 16 and 18 of the vertical section 14 to the upper and lower sections 104 and 108 of the enclosed safety cage 100.

Located above the center point 17 of the vertical section 14 is an upper, upwardly extending open-loop line control 24 that is integrally attached normal to the vertical section 14. Below the center point 17 of the vertical section 14 and in alignment with the upper, open-loop line control 24 is likewise located a downwardly extending open-loop line control 26.

A safety line 30 having an upper end 32 and a lower end 34 is attached by an attachment means 94 to a fixed cantilevered post 96 attached to a fixed elevated structure 90 such as an elevated building 98 as shown in FIG. 8. The line 30, attachment means 94 and the cantilevered post 96 are selected to support the enclosed safety cage 100 and the occupants therein. The lower end of the safety line 30 is inserted through the upper line bore 106 and wrapped around the upper and lower open-loop line controls 24 and 26 as also shown in FIG. 8. When the safety cage 100 is not in use the lower portion, including the lower end 34 of the safety line 30, is coiled and placed on the lower section 108 of the cage 100. When the safety cage is in use the lower end 34 of the safety line 30 is inserted through the lower line bore 110 from where it freely extends downward, preferably utilizing a weight 40 attached to the end to stabilize the safety line 30.

An alternate safety line attachment means is shown in FIG. 9. The means utilizes a winch 122 which is attached to the top surface of the fixed elevated structure 90 or to the top surface of the cantilevered post 96 as shown in FIG. 9 and a wheel pulley 124 also attached to the top surface of the structure 90 in alignment with the winch 122. The cantilevered post 96 in this design includes at its outer end, a line guide bore 126 therethrough. To utilize this alternate line attachment means, the upper end 32 of the safety line 30 is attached to the winch 122 and the lower end 34 of the line 30 traverses the wheel pulley 124 and extends through the line guide bore 126 on the cantilevered post 96. The remainder of the safety line follows the same route as previously described.

The second embodiment of the self-belaying descending apparatus 10 is operated by performing the following steps:

1. open or break-away the window 97 that faces the safety cage 100,
2. open the door 102 of the safety cage,
3. carefully enter the safety cage and close the door 102,
4. insert the lower end 34 of the safety line 30 through the lower line bore 110 to allow the line to hang loosely to the bottom of the building 98 as shown in FIG. 8,
5. remove a loop of the safety line 30 wrapped around the upper and lower open-loop line controls 24 and 26 until the safety cage 100 commences to drop slowly. The number of line wraps determine the uncontrolled descent rate of the cage 100 and the number of line wraps is dependent upon the number of persons in the safety cage,
6. grasp the safety line 30 wrapped around the upper and lower open loop line controls 24 and 26 and control the descend rate of the safety cage 100 by applying hand pressure to the line 30, The upper and lower open-loop line controls 24 and 26 are spaced apart so that if necessary, two persons can grasp the safely line 30 to control the descend rate. When safely down, release the hand(s) from the upper and lower open-loop line controls 24 and 26 and 7. open the door 102 of the safety cage and step out.

While the invention has been described in complete detail and pictorially shown in the accompanying drawings it is not to be limited to such details, since many changes and modifications may be made to the invention without departing from the spirit and the scope thereof. For example, the safety cage 100 can be designed with various safety line attachment means. These means can consist of using a second weighted line as a pulley that allows the cage to be automatically raised when the cage is empty and on the ground. Hence, it is described to cover any and all modifications and forms which may come within the language and scope of the claims.

I claim:

1. A self-belaying descending apparatus comprising:

a) a descending control device comprising:

(1) a vertical section having an upper end and a lower end, where to the upper end is attached a line guide and to the lower end is attached a body support means, (2) an upper line control attached to the vertical section and located below the line guide wherein said upper line control comprises an open loop, where the open area of the loop faces upward and, (3) a lower line control attached to the vertical section, in alignment with the upper line control, and located above the body support, b) a safety line having an upper end and a lower end, where the upper end has means for being attached to a fixed structure and the lower end is inserted through the line guide and wrapped around the upper and lower line controls with the lower end of said safety line freely extending downward, and c) a body support having a front and back section, means for being securely attached to the body and means for attaching the body support means on said device to the front section of said body support.

2. A self-belaying descending apparatus comprising:

a) a descending control device comprising:

(1) a vertical section having an upper end and a lower end, where to the upper end is attached a line guide and to the lower end is attached a body support means, (2) an upper line control attached to the vertical section and located below the line guide and, (3) a lower line control attached to the vertical section, in alignment with the upper line control, and located above the body support wherein said lower line control comprises an open loop, where the open area of the loop faces downward, b) a safety line having an upper end and a lower end, where the upper end has means for being attached to a fixed structure and the lower end is inserted through the line guide and wrapped around the upper and lower line controls with the lower end of said safety line freely extending downward, and c) a body support having a front and back section, means for being securely attached to the body and means for attaching the body support means on said device to the front section of said body support.

3. A self-belaying descending apparatus comprising:

a) a descending control device comprising:

(1) a vertical section having an upper end and a lower end, where to the upper end is integrally attached an open-loop line guide, and to the lower end is integrally attached a body support eyelet, (2) an upper, upwardly extending open-loop line control integrally attached normal to the vertical section and located below the open-loop line guide, and (3) a lower, downwardly extending open-loop line control integrally attached normal to the vertical section, in alignment with the upper open-loop line control and located above the body support eyelet, b) a safety line having an upper end and a lower end, where the upper end is attached by an attachment means to a fixed elevated structure and the lower end is inserted through the open-loop line guide and wrapped around the upper and lower line controls with the lower end of said safety line freely extending downward, and c) a body support having an integral front and back section, a means for being securely attached to the body and a means for attaching the body support eyelet on said device to the front section.

4. The apparatus as specified in claim 3 wherein around the end of the line guide on said descending control device further comprises a slidable sleeve that when slid outward, prevents said safety line from slipping out the line guide.

5. The apparatus as specified in claim 3 wherein said safety line is manufactured from nylon.

6. The apparatus as specified in claim 3 wherein said means for attaching the upper end of said safety line to a fixed structure comprises a metal ring attached to a secured loop on said safety line.

7. The apparatus as specified in claim 3 wherein the lower end of said safety line further comprises a line stabilizing weight attached thereto by an attachment means.

8. The apparatus as specified in claim 3 wherein said body support structure comprises a waist belt having a front section, a buckle which provides the means for attaching said waist belt to the body and further having attached to the front section a carribiner that provides the means for attaching the body support eyelet on said descending control device.

9. The apparatus as specified in claim 3 wherein said body support structure comprises an integrated buckled waist belt cross harness having with the cross harness a front section to which is attached a carribiner that provides the means for attaching the body support eyelet on said descending control device.

10. The apparatus as specified in claim 3 wherein said body support comprises a pair of pants integrally attached to a shoulder harness having attached to the front section a carribiner that provides the means for attaching the body support eyelet on said descending control device.

11. A method for safety descending from a fixed elevated structure by utilizing a self-belaying and descending apparatus comprising a descending control device having a vertical section having an upper end and a lower end, where to the upper end is integrally attached an open-loop line guide, and to the lower end is integrally attached a body support eyelet, an upper, upwardly extending open-loop line control integrally attached normal to the vertical section and below the open-loop line guide, and a lower, downwardly extending open-loop line control integrally attached normal to the vertical section, in alignment with the upper open-loop line control and above the body support eyelet, said apparatus further comprising a safety line having an upper end and a lower end and a body support, where said apparatus is operated by performing the following steps:

a) attach the upper end of said safety line to an elevated structure, b) attach the body support, c) insert the lower end of said safety line through the open-loop line guide of said device and continue by wrapping said line around the upper and lower open-loop line controls, d) attach the body support eyelet on said device to the front section of said body support, e) grasp said safety line and said vertical section between said upper and lower line controls while the safety line is wrapped around the upper add lower line controls with at least one hand and step off the structure to commence the descent, and f) control the descend rate by applying hand pressure to said safety line wrapped around the upper and lower line controls, when safety down, remove said device and said body support.

* * * * *